US006125917A

United States Patent [19]

Cassar et al.

[11] Patent Number: 6,125,917

[45] Date of Patent: Oct. 3, 2000

[54] STRIP CASTING APPARATUS

[75] Inventors: Paul Cassar, Balgownie; Colin Robert Dean, Oak Flats, both of Australia

[73] Assignees: Ishikawajima-Harima Heavy Industries Limited, Tokyo, Japan; BHP Steel (JLA) Pty Ltd., Sydney, Australia

[21] Appl. No.: 09/229,570

[22] Filed: Jan. 13, 1999

[30] Foreign Application Priority Data

Feb. 24, 1998 [AU] Australia ..... PP1977

[51] Int. Cl.[7] ..... B22D 11/06; B22D 11/10

[52] U.S. Cl. ..... 164/428; 164/437; 222/607

[58] Field of Search ..... 164/437, 488, 164/428, 480; 222/606, 607

[56] References Cited

U.S. PATENT DOCUMENTS 5,924,476 7/1999 Spink ..... 164/480
5,983,981 11/1999 Spink ..... 164/480
6,003,589 12/1999 Folder ..... 164/428
6,012,508 1/2000 Folder ..... 164/480

*Primary Examiner*—Kuang Y. Lin
*Attorney, Agent, or Firm*—Miles & Stockbridge P.C.; John C. Kerins

[57] ABSTRACT

Metal delivery nozzle 19 for a twin roll caster is formed in two pieces 19A disposed end to end with a gap 50 between them. Each nozzle piece 19A is mounted on two pairs of mounting brackets 60. Outer end parts of the nozzle pieces 19A are constrained by the interengagement of mounting bracket projections 71 and nozzle recesses 72 such that thermal expansion of the nozzle pieces is accommodated by inward movement into the gap 50. Projection 71 may be upstanding lugs and nozzle recesses 72 may be slots in the undersides of nozzle side flanges.

15 Claims, 6 Drawing Sheets

80
55
64
81
72
70
10
95
98
87
96
83
61
85
89
92
88
91
93
94
63
11
12

STRIP CASTING APPARATUS

BACKGROUND OF THE INVENTION

This invention relates to the casting of metal strip. It has particular but not exclusive application to the casting of ferrous metal strip.

It is known to cast metal strip by continuous casting in a twin roll caster. Molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip so as to direct it into the nip between the rolls, so forming a casting pool of molten metal supported on the casting surfaces of the rolls immediately above the nip. This casting pool may be confined between side plates or dams held in sliding engagement with the ends of the rolls.

Although twin roll casting has been applied with some success to non-ferrous metals which solidify rapidly on cooling, there have been problems in applying the technique to the casting of ferrous metals which have high solidification temperatures and tend to produce defects caused by uneven solidification at the chilled casting surfaces of the rolls. One particular problem arises due to the formation of pieces of solid metal known as "skulls" in the vicinity of the pool confining side plates or dams. These problems are exacerbated when efforts are made to reduce the superheat of the incoming molten metal. The rate of heat loss from the melt pool is greatest near the side dams due primarily to additional conductive heat transfer through the side dams to the roll ends. This high rate of local heat loss is reflected in the tendency to form "skulls" of solid metal in this region which can grow to a considerable size and fall between the rolls causing defects in the strip generally known as "snake eggs". Because the net rate of heat loss is higher near the side dams the rate of heat input to these regions must be increased if skulls are to be prevented. It has therefore been proposed to provide an increased flow of metal to these "triple point" regions (ie. where the side dams and casting rolls meet in the meniscus regions of the casting pool) by providing flow passages in the end of the core nozzle to direct separate flows of metal to the triple point regions. Examples of such proposals may be seen in U.S. Pat. Nos. 4,694,887, 5,221,511 and our earlier Australian Patent Application 35218/97 based on Provisional Application PO2367.

Although triple point pouring has been effective to reduce the formation of skulls in the triple point regions of the pool it has not been possible completely to eliminate the problem because the generation of defects is remarkably sensitive to even minor variations in the flow of metal into the triple point regions of the pool. We have now determined that significant flow changes are brought about by variation in the position in the ends of the core nozzles relative to the side dams which may be brought about by inaccurate location of the core nozzle during set up and by subsequent movement of the nozzle ends due to thermal expansion during casting. As the gap between the nozzle end and the side dam is reduced the downwardly inclined flow of metal from the triple point pouring passages in the ends of the nozzle impinges higher on the side dams. This can lead to the formation of skulls with subsequent snake egg defects or in extreme cases can cause the poured metal to surge upwardly in the reduced gap between the nozzle ends and side dams to spill over the upper edges of the side dams. The present invention enables this problem to be overcome by simple modifications to the manner in which the metal delivery nozzle is mounted and held in position.

SUMMARY OF THE INVENTION

According to the invention there is provided apparatus for casting metal strip including a pair of parallel casting rolls forming a nip between them, an elongate metal delivery nozzle formed in two discrete elongate pieces disposed end to end, nozzle support means supporting the nozzle pieces such that the nozzle extends above and along the nip between the casting rolls for delivery of molten metal into the nip whereby to form a casting pool of molten metal supported above the nip, and a pair of pool confinement closures at the ends of the nip, wherein the two outer ends of the nozzle are formed with metal outlet passages to direct molten metal in streams directed towards the pool confining end closures, and wherein outer end parts of the nozzle pieces are engaged by the nozzle support means such that there is a gap between the nozzle pieces and those parts of the nozzle pieces disposed inwardly of said support means are free to expand longitudinally inwardly to accommodate thermal expansion of the nozzle pieces during casting, and wherein the engagement of the nozzle support means and the outer end parts limits outward longitudinal thermal expansion of the nozzle pieces.

Preferably the support means and the nozzle end pieces are provided with interengaging projections and recesses to provide the engagement of the support means and the outer end parts of the nozzle pieces.

More specifically, the nozzle support means may comprise projections in the form of lugs which interengage with recesses in said end parts of the nozzle pieces.

The nozzle support means may comprise support brackets to support the inner and outer ends of the nozzle pieces and the lugs may be formed in the brackets supporting the outer ends of the nozzle pieces.

The support brackets may engage side walls of the nozzle pieces.

There may be a pair of brackets at each end of each nozzle piece in which case there may be a constraining lug on one or each of the brackets supporting a nozzle outer end with a corresponding one or more recesses formed in the nozzle end.

The nozzle pieces may comprise upwardly opening elongate troughs to receive discrete streams of molten metal from a distributor, trough outlet means to deliver molten metal from the trough into the casting pool, and outer end formations defining reservoirs for molten metal at the two ends of the nozzle which each receive discrete streams of molten metal from the distributor and supply that molten metal to said metal outlet passages at the ends of the nozzle.

The invention also extends to a refractory nozzle for delivery of molten metal to a casting pool of a twin roll caster, said nozzle comprising a pair of elongate nozzle pieces disposable end to end to define the nozzle, said nozzle pieces being formed with respective upwardly opening elongate troughs, trough outlet means to deliver molten metal from the trough outwardly from the nozzle, outer end formations defining reservoirs for molten metal at the two ends of the nozzle, flow passages extending from said reservoirs to direct molten metal from the reservoirs in streams directed downwardly from the nozzle end formations, and recesses formed in external side walls of outer end parts of the nozzle pieces for engagement with nozzle supports so as to limit outward longitudinal thermal expansion of the nozzle pieces.

Preferably, the nozzle pieces are formed with laterally outwardly projecting side flanges and the recesses are in the form of slots in those side flanges.

Preferably further, there is a single slot at each end of the nozzle or a pair of said slots at each end of the nozzle disposed one to each side of the nozzle.

Preferably further, each of said reservoirs is separated from the respective nozzle trough by a wall over which molten metal can flow into the trough from the reservoir when the reservoir is full.

BRIEF DESCRIPTION OF THE DRAWINGS

In order that the invention may be more fully explained one particular method and apparatus will be described in some detail with reference to the accompanying drawings in which.

DESCRIPTION OF PREFERRED EMBODIMENT

Figure 1:
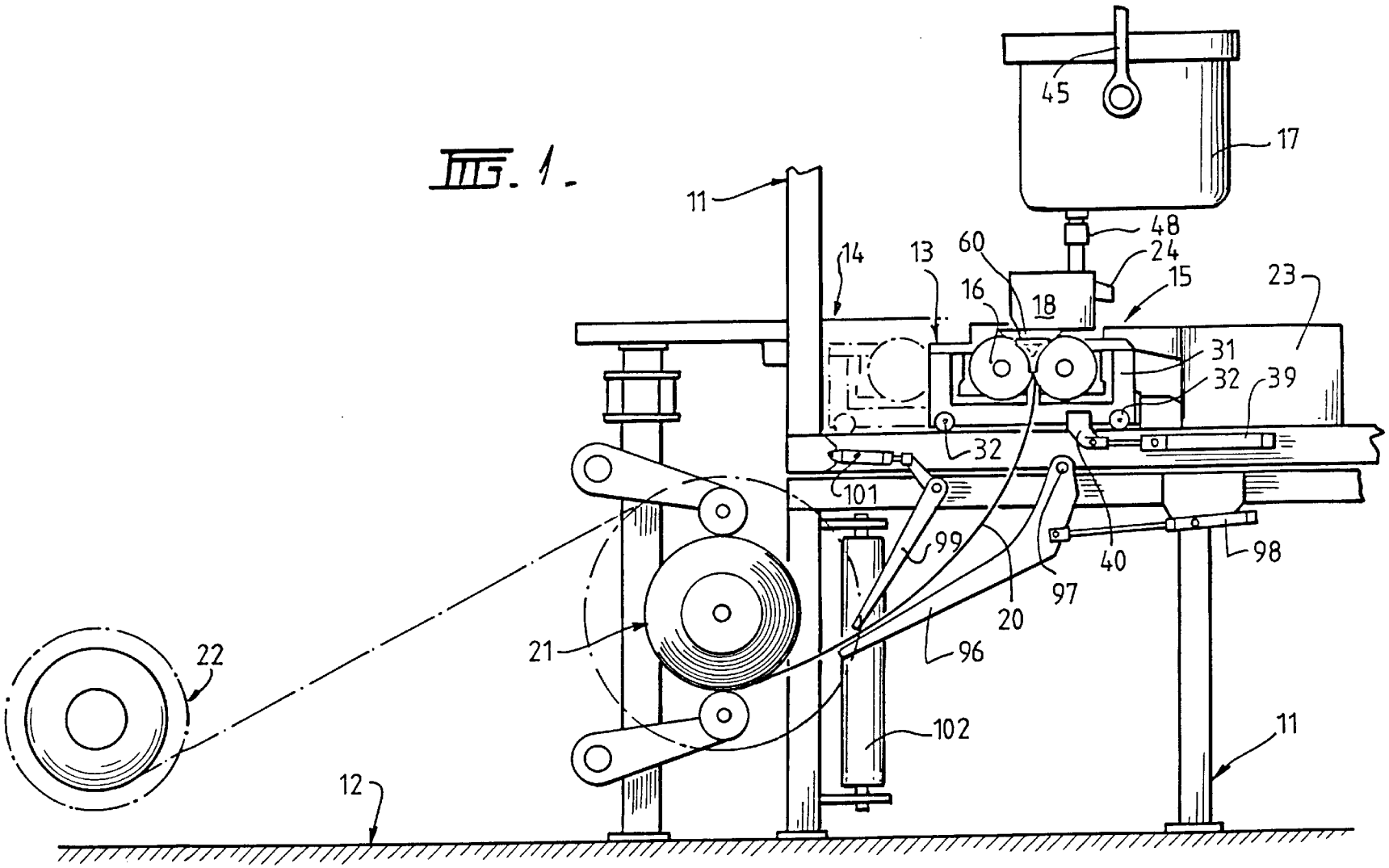
FIG. 1 illustrates a twin-roll continuous strip caster constructed and operating in accordance with the present invention.
Figure 2:
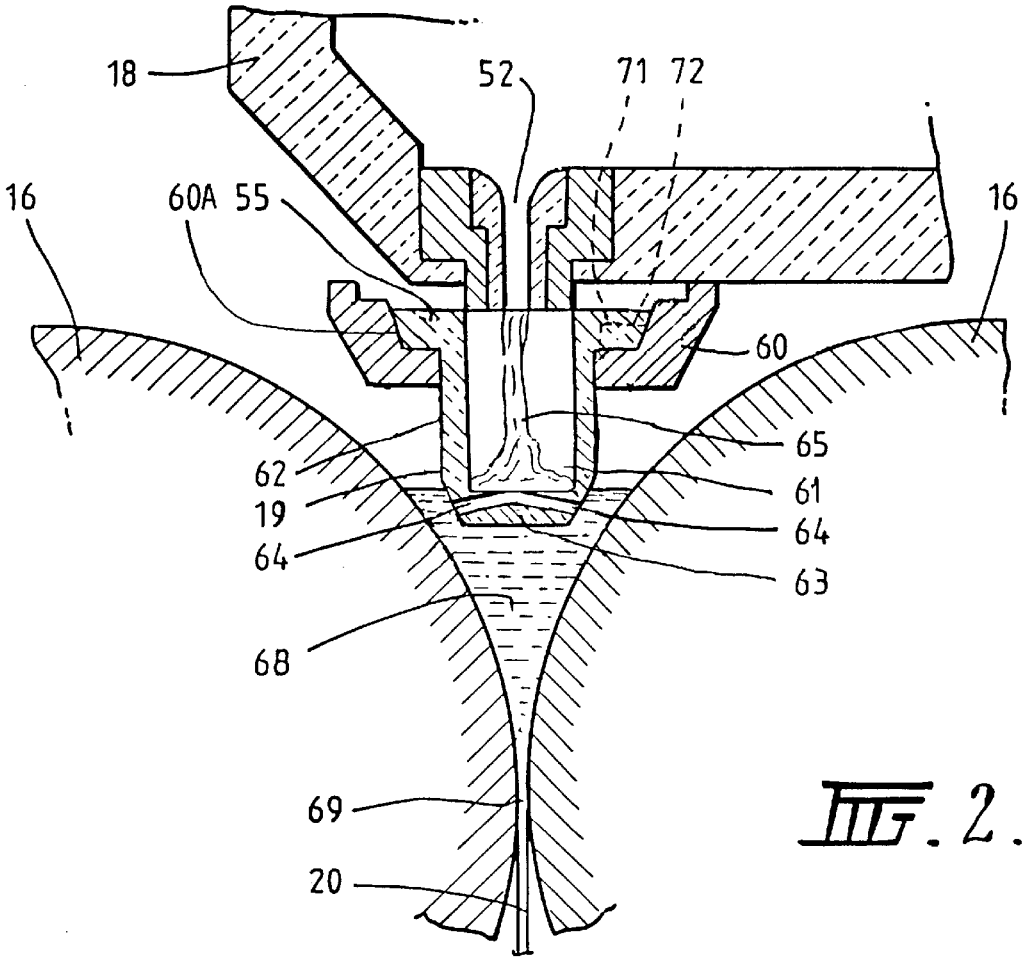
FIG. 2 is a vertical cross-section through important components of the caster illustrated in FIG. 1 including a metal delivery nozzle constructed in accordance with the invention.
Figure 3:
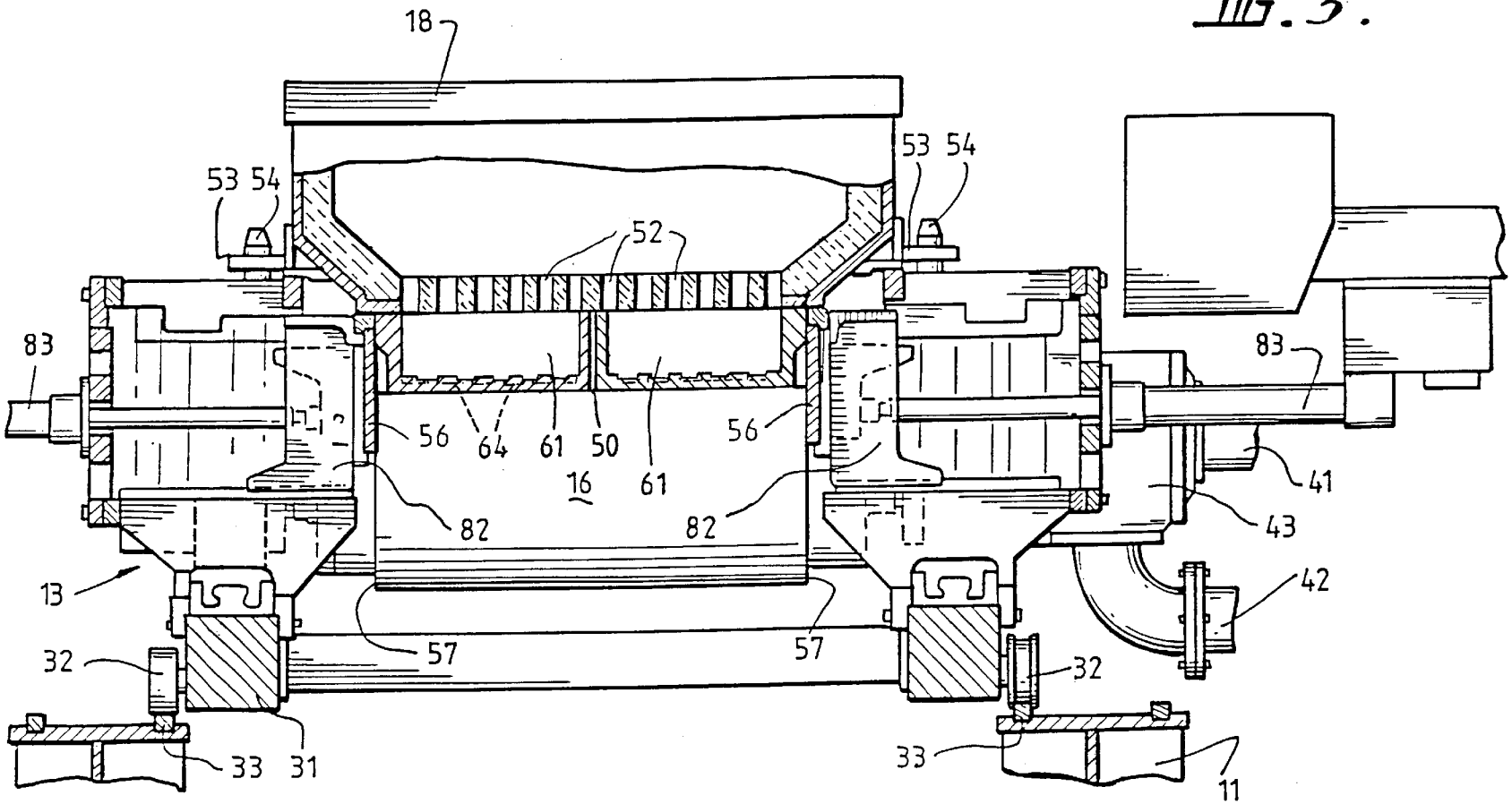
FIG. 3 is a further vertical cross-section through important components of the caster taken transverse to the section of FIG. 2.

The illustrated caster comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation via a distributor 18 and delivery nozzle 19. Casting rolls 16 are water cooled so that shells solidify on the moving roll surfaces and are brought together at the nip between them to produce a solidified strip product 20 at the nip outlet. This product is fed to a standard coiler 21 and may subsequently be transferred to a second coiler 22.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles (not shown) in which the rolls 16 are rotatably mounted. Carriage 13 is movable along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and visa versa.

Casting rolls 16 are contra rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The rolls may typically be about 500 mm diameter and up to 2 m long in order to produce up to 2 m wide strip product.

Distributor 18 is formed as a wide dish made of a refractory material such as high alumina castable with a sacrificial lining. One side of the distributor receives molten metal from a ladle. The other side of the distributor is provided with a series of longitudinally spaced metal outlet openings 52. The lower part of the distributor carries mounting brackets 53 for mounting the distributor onto the roll carriage frame 31 and provided with apertures to receive indexing pegs 54 on the carriage frame so as accurately to locate the distributor.

Figure 4:
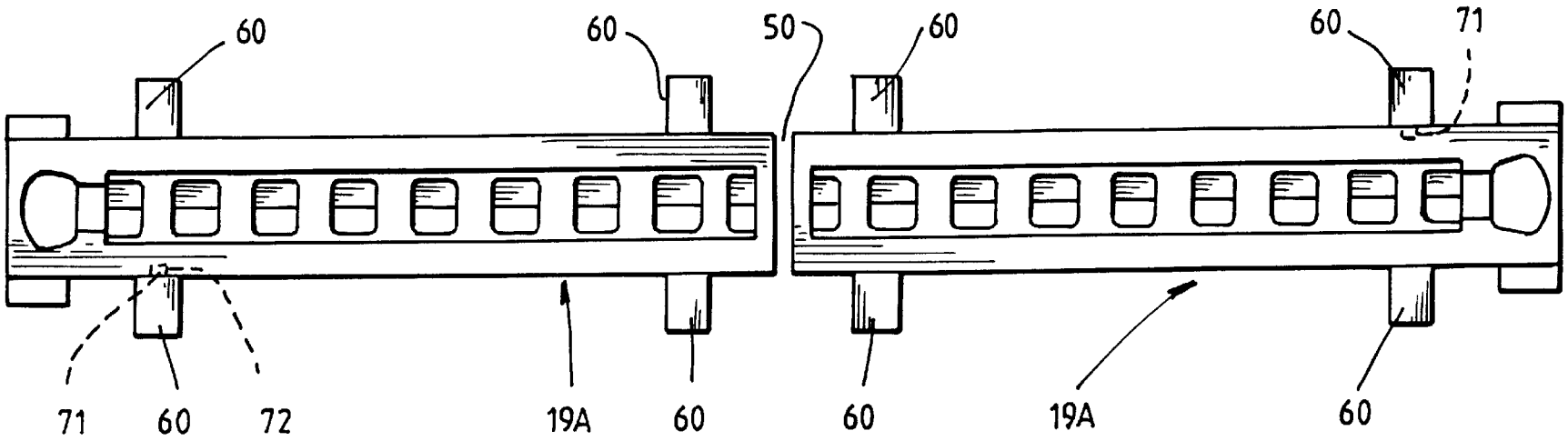
FIG. 4 is a plan view of the metal delivery nozzle and nozzle support brackets.
Figure 4A:
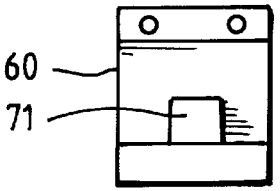
FIG. 4A illustrates one of the nozzle support brackets.
Figures 5, 6, 7:
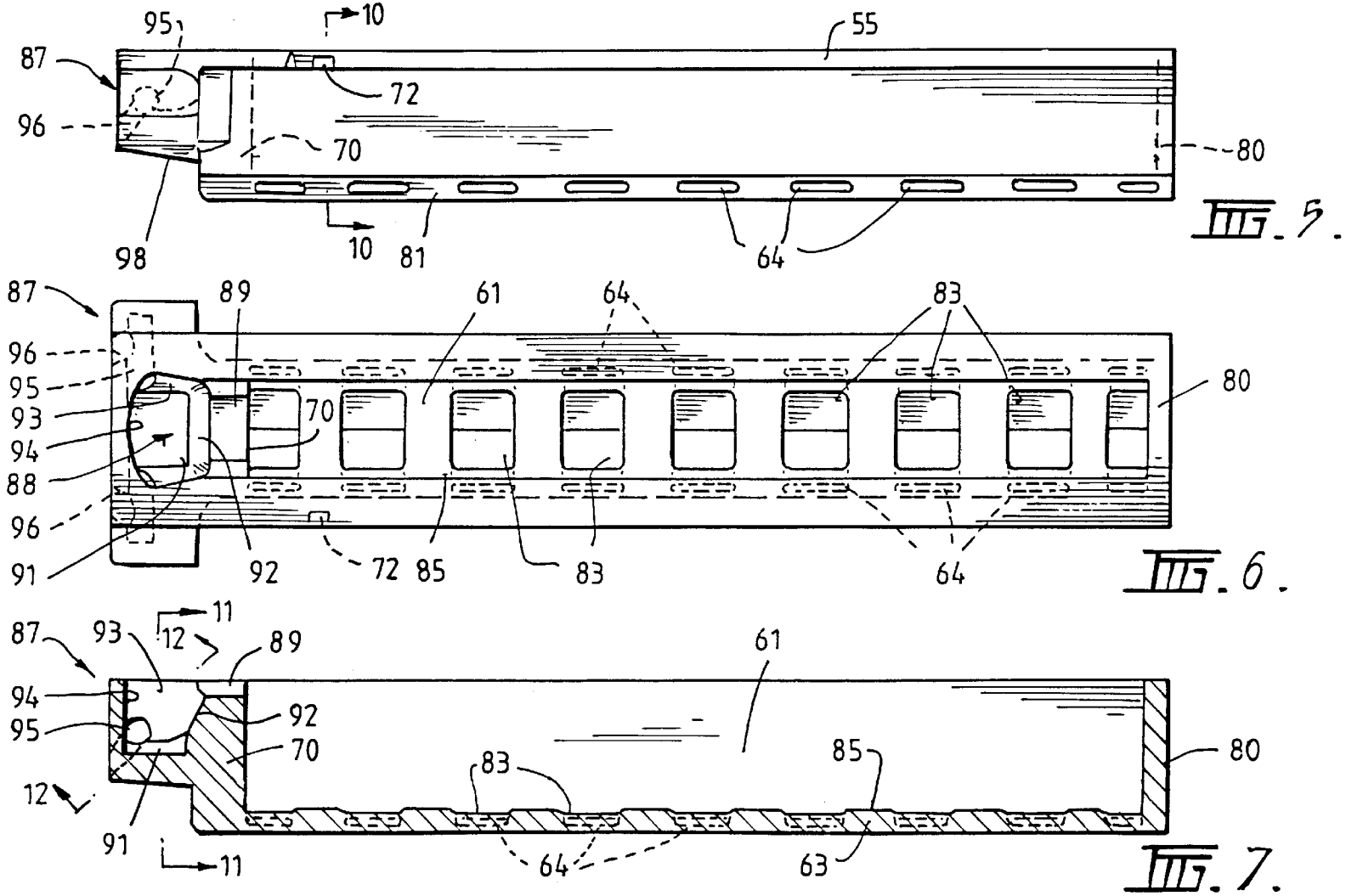
FIG. 5 is a side elevation of a one half segment of the metal delivery nozzle.
FIG. 6 is a plan view of the nozzle segment shown in FIG. 5.
FIG. 7 is a longitudinal cross-section through the delivery nozzle segment.
Figure 8:
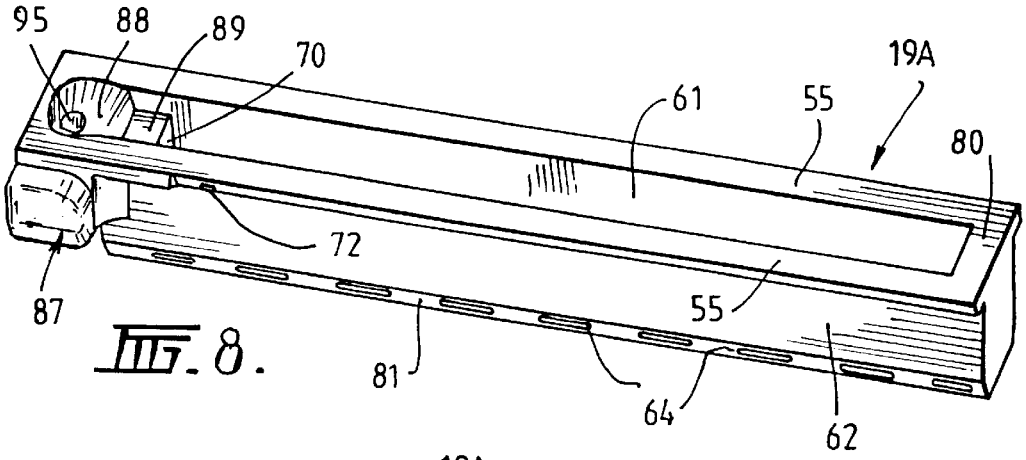
FIG. 8 is a perspective view of the delivery nozzle segment.
Figure 9:
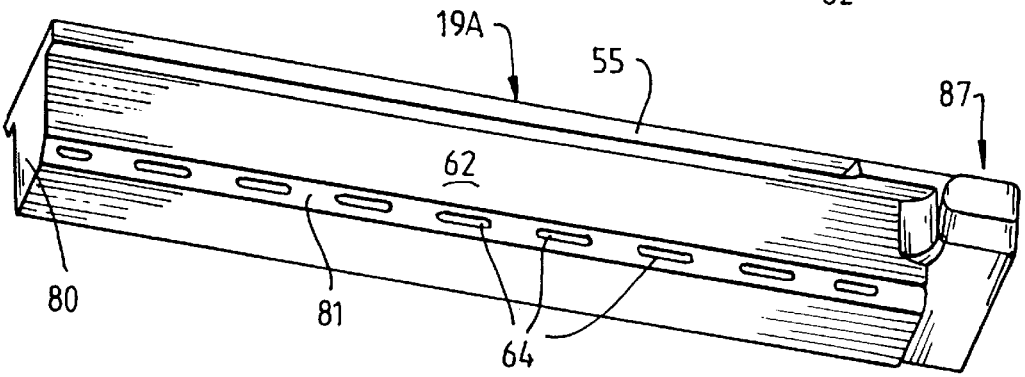
FIG. 9 is an inverted perspective view of the nozzle segment.
Figure 10:
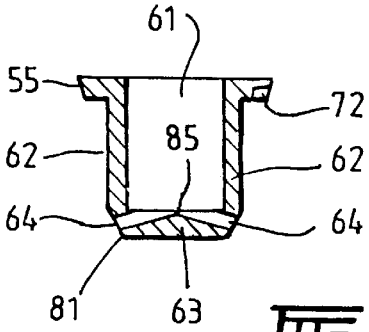
FIG. 10 is a transverse cross-section through the delivery nozzle segment on the line 10—10 in FIG. 5.
Figure 11:
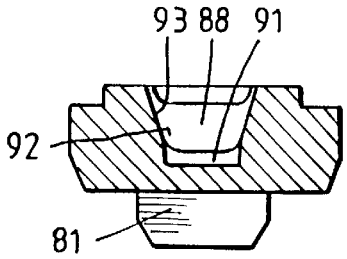
FIG. 11 is a cross-section on the line 11—11 in FIG. 7.
Figure 12:
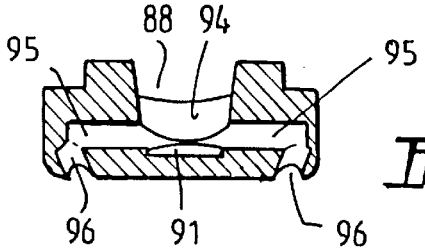
FIG. 12 is a cross-section on the line 12—12 in FIG. 7.

Delivery nozzle 19 is formed by two discrete elongate pieces 19A supported on the roll carriage frame by stainless steel mounting brackets 60. Nozzle pieces 19A are formed as identical nozzle half segments made of a refractory material such as alumina graphite. Each of these nozzle pieces is mounted by two pairs of the brackets 60 in the manner shown in FIG. 4 with a pair of brackets supporting each end of the nozzle piece. The pieces are supported so as to be disposed in end to end relationship with a gap 50 between them. The upper parts of the nozzle pieces are formed with outwardly projecting side flanges 55 which locate on the mounting brackets. The outer edges of side flanges 55 are upwardly and outwardly tapered and engage complementary inclined inner faces 60A on the brackets 60 to locate the nozzle pieces 19A against lateral movement.

In accordance with the present invention outer end parts of the nozzle pieces are engaged by the interengagement of mounting bracket projections 71 and nozzle recesses 72. Mounting bracket projections may be in the form of upstanding lugs and nozzle recesses 72 may be in the form of slots formed in the undersides of the nozzle side flanges 55 adjacent the outer ends of the nozzle. As shown in the drawings there may be only a single slot at each end of the nozzle and a complementary lug on only one of each outer pair of supporting brackets. Alternatively both brackets at each end of the nozzle may be provided with locating lugs and the nozzle pieces 19A may each have a pair of side flange slots disposed one to each side of the nozzle.

The construction of the nozzle pieces 19A is illustrated in FIGS. 5 to 12. Each nozzle piece is of generally trough formation so that the nozzle 19 defines an upwardly opening inlet trough 61 to receive molten metal flowing downwardly from the openings 52 of the distributor. Trough 61 is formed between nozzle side walls 62 and end walls 70 and may be considered to be transversely partitioned between its ends by the two flat end walls 80 of the nozzle pieces 19A which are spaced apart to form the gap 50. The bottom of the trough is closed by a horizontal bottom floor 63 which meets the trough side walls 62 at chamfered bottom corners 81. The nozzle is provided at these bottom corners with a series of side openings in the form of longitudinally spaced elongate slots 64 arranged at regular longitudinal spacing along the nozzle. Slots 64 are positioned to provide for egress of molten metal from the trough at the level of the trough floor 63. The trough floor is provided adjacent the slots with recesses 83 which slope outwardly and downwardly from the centre of the floor toward the slots and the slots continue as extensions of the recesses 83 to slot outlets 84 disposed in the chamfered bottom corners 80 of the nozzle beneath the level of the upper floor surface 85.

The outer ends of the nozzle segments are provided with triple point pouring end formations denoted generally as 87 extending outwardly beyond the nozzle end wall 70. Each end formation 87 defines a small open topped reservoir 88 to receive molten metal from the distributor, this reservoir being separated from the main trough of the nozzle by the end wall 70. The upper end 89 of end wall 70 is lower than the upper edges of the trough and the outer parts of the reservoir 88 and can serve as a weir to allow back flow of molten metal into the main nozzle trough from the reservoir 88 if the reservoir is over filled, as will be more fully explained below.

Reservoir 88 is shaped as a shallow dish having a flat floor 91, inclined inner and side faces 92, 93 and a curved upright outer face 94. A pair of triple point pouring passages 95 extend laterally outwardly from this reservoir just above the level of the floor 91 to connect with triple point pouring outlets 96 in the undersides of the nozzle end formations 87, the outlets 96 being angled downwardly and inwardly to deliver molten metal into the triple point regions of the casting pool.

Molten metal falls from the outlet openings 52 of the distributor in a series of free-falling vertical streams 65 into the bottom part of the nozzle trough 61. Molten metal flows from this reservoir out through the side openings 64 to form a casting pool 68 supported above the nip 69 between the casting rolls 16. The casting pool is confined at the ends of rolls 16 by a pair of side closure plates 56 which are held against the ends 57 of the rolls. Side closure plates 56 are made of strong refractory material, for example boron nitride. They are mounted in plate holders 82 which are movable by actuation of a pair of hydraulic cylinder units 83 to bring the side plates into engagement with the ends of the casting rolls to form end closures for the casting pool of molten metal.

In the casting operation the flow of metal is controlled to maintain the casting pool at a level such that the lower end of the delivery nozzle 19 is submerged in the casting pool and the two series of horizontally spaced side openings 64 of the delivery nozzle are disposed immediately beneath the surface of the casting pool. The molten metal flows through the openings 64 in two laterally outwardly directed jet streams in the general vicinity of the casting pool surface so as to impinge on the cooling surfaces of the rolls in the immediate vicinity of the pool surface. This maximises the temperature of the molten metal delivered to the meniscus regions of the pool and it has been found that this significantly reduces the formation of cracks and meniscus marks on the melting strip surface.

Molten metal is caused to flow from the extreme bottom part of the nozzle trough 61 through the nozzle side openings 64 generally at the level of the floor of the trough. The metal enters the casting pool in mutually oppositely directed jet streams immediately below the surface of the pool to impinge on the casting roll surfaces in the meniscus regions of the pool.

It is important to note that nozzle side slots 64 are provided at the inner ends of the two nozzle sections. This ensures adequate delivery of molten metal to the pool in the vicinity of the central partition in the nozzle and avoids the formation of skulls in this region of the pool.

The triple point pouring reservoirs 88 receive molten metal from the two outermost streams 65 falling from the distributor 18. The alignment of the two outermost holes 52 in the distributor is such that each reservoir 88 receives a single stream impinging on the flat floor 91 immediately outside the sloping side face 92. The impingement of the molten metal on floor 88 causes the metal to fan outwardly across the floor and outwardly through the triple point pouring passages 95 to the outlets 96 which produce downwardly and inwardly inclined jets of hot metal directed across the faces of the side dams and along the edges of the casting rolls toward the nip. Triple point pouring proceeds with only a shallow and wide pool of molten metal within each of the troughs 88, the height of this pool being limited by the height of the upper end 89 of the wall 70. When reservoir 88 is filled molten metal can flow back over the wall end 89 into the main nozzle trough so that the wall end serves as a weir to control the depth of the metal pool in the triple point pouring supply reservoir 88. The depth of the pool is more than sufficient to supply the triple point pouring passages so as to maintain flow at a constant head whereby to achieve a very even flow of hot metal through the triple point pouring passages. This control flow is most important to proper formation of the edge parts of the strip. Excessive flow through the triple point passages can lead to bulging in the edges of the strip whereas to little flow will produce skulls and "snake egg" defects in the strip.

During casting the core nozzle pieces 19A undergo very significant thermal expansion through contact with the molten steel at temperatures of the order of 1600° C. or more. In a typical installation each nozzle piece 19A may for example be about 650 cm long and the thermal expansion may produce a change in length of up to 12 mm. The gap between the core nozzle ends and the side dams will usually be of the order of 15 mm to produce effective triple point pouring of molten metal across the side dams. Accordingly the thermal expansion of the nozzle is very significant and without the aid of the present invention can lead to a severe reduction in the gap between the nozzle ends and the side dams, causing the molten metal leaving the triple point pouring passages 96 to impinge on the upper parts of the side dams above the casting pool leading to the formation of skulls and in extreme cases spilling of metal over the upper edges of the side dams. In accordance with the present invention the outer end parts of the nozzle pieces 19A are engaged by the interengaging mounting bracket projections 71 and nozzle recesses 72 such that thermal expansion of the nozzle pieces is accommodated by inward movement as allowed by the gap 50 between the nozzle pieces. It has been found that by this simple expedient the formation of skulls and spilling at the ends of the casting pool can be eliminated.

The positioning of the interengaging slots are lugs is not particularly critical but it is preferred to position them as closely as possible to the outer ends of the nozzle. Typically, the slots may be about 160 mm from the nozzle ends.

The illustrated apparatus has been advanced by way of example only and the invention is not limited to the details of that apparatus. In particular, it is not essential that the nozzle trough be provided with side openings of the kind shown in the illustrated apparatus, although that is the presently preferred form of nozzle. The invention may be applied to any form of nozzle providing for pouring of molten metal from its ends.

What is claimed is:

1. Apparatus for casting metal strip including a pair of parallel casting rolls forming a nip between them, an elongate metal delivery nozzle formed in two discrete elongate pieces disposed end to end, nozzle support means supporting the nozzle pieces such that the nozzle extends above and along the nip between the casting rolls for delivery of molten metal into the nip whereby to form a casting pool of molten metal supported above the nip, and a pair of pool confinement closures at the ends of the nip, wherein the two outer ends of the nozzle are formed with metal outlet passages to direct molten metal in streams directed towards the pool confining end closures, and wherein outer end parts of the nozzle pieces are engaged by the nozzle support means such that there is a gap between the nozzle pieces and those parts of the nozzle pieces disposed inwardly of said support means are free to expand longitudinally inwardly to accommodate thermal expansion of the nozzle pieces during casting, and wherein the engagement of the nozzle support means and the outer end parts limits outward longitudinal thermal expansion of the nozzle pieces.

2. Apparatus as claimed in claim 1, wherein the support means and the nozzle end pieces are provided with interengaging projections and recesses to provide the engagement of the support means and the outer end parts of the nozzle pieces.

3. Apparatus as claimed in claim 2, wherein the projections are in the form of lugs on the nozzle support means and the recesses are formed in said end parts of the nozzle pieces.

4. Apparatus as claimed in claim 3, wherein the nozzle support means comprises support brackets supporting the inner and outer ends of the nozzle pieces and the lugs are formed in the brackets supporting the outer ends of the nozzle pieces.

5. Apparatus as claimed in claim 1, wherein the nozzle support means comprises support brackets supporting the inner and outer ends of the nozzle pieces and provided with lugs to engage recesses in the inner and outer ends of the nozzle pieces.

6. Apparatus as claimed in claim 5, wherein there is a pair of said brackets at each end of the each nozzle piece.

7. Apparatus as claimed in claim 6, wherein there is one of said lugs on one or each of the brackets supporting a nozzle outer end with a corresponding one or more of said recesses formed in the respective nozzle end.

8. Apparatus as claimed in claim 3, wherein the nozzle pieces are formed with laterally outwardly projecting side flanges and the recesses are in the form of slots in those side flanges.

9. Apparatus as claimed in claim 1, wherein the nozzle pieces comprising upwardly opening elongate troughs to receive discrete streams of molten metal from a distributor, trough outlet means to deliver molten metal from the trough into the casting pool, and outer end formations defining reservoirs for molten metal at the two ends of the nozzle which each receive discrete streams of molten metal from the distributor and supply that molten to said metal outlet passages at the ends of the nozzle.

10. Apparatus as claimed in claim 9, wherein each of said reservoirs is separated from the respective nozzle trough by a wall over which molten metal can flow into the trough from the reservoir when the reservoir is full.

11. A refractory nozzle for delivery of molten metal to a casting pool of a twin roll caster, said nozzle comprising a pair of elongate nozzle pieces disposable end to end to define the nozzle, said nozzle pieces being formed with respective upwardly opening elongate troughs, trough outlet means to deliver molten metal from the trough outwardly from the nozzle, outer end formations defining reservoirs for molten metal at the two ends of the nozzle, flow passages extending from said reservoirs to direct molten metal from the reservoirs in streams directed downwardly from the nozzle end formations, and recesses formed in external side walls of outer end parts of the nozzle pieces for engagement with nozzle supports so as to limit outward longitudinal thermal expansion of the nozzle pieces.

12. A refractory nozzle as claimed in claim 11, wherein the nozzle pieces are formed with laterally outwardly projecting side flanges and the recesses are in the form of slots in those side flanges.

13. A refractory nozzle as claimed in claim 12, wherein there is a single slot at each end of the nozzle.

14. A refractory nozzle as claimed in claim 12, wherein there is a pair of said slots at each end of the nozzle disposed one to each side of the nozzle.

15. A refractory nozzle as claimed in claim 11, wherein each of said reservoirs is separated from the respective nozzle trough by a wall over which molten metal can flow into the trough from the reservoir when the reservoir is full.

* * * * *